US011478081B2

(12) United States Patent
Petker

(10) Patent No.: US 11,478,081 B2
(45) Date of Patent: Oct. 25, 2022

(54) DEVICE FOR FIXING A DRAWER-TYPE ELEMENT AND PIECE OF FURNITURE

(71) Applicant: Paul Hettich GmbH & Co. KG, Kirchlengern (DE)

(72) Inventor: Waldemar Petker, Buende (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 16/757,866

(22) PCT Filed: Nov. 13, 2018

(86) PCT No.: PCT/EP2018/081047

§ 371 (c)(1),
(2) Date: Apr. 21, 2020

(87) PCT Pub. No.: WO2019/101574

PCT Pub. Date: May 31, 2019

(65) Prior Publication Data

US 2021/0186212 A1 Jun. 24, 2021

(30) Foreign Application Priority Data

Nov. 23, 2017 (DE) ..... 10 2017 127 749.8
Jun. 19, 2018 (DE) ..... 10 2018 114 712.0

(51) Int. Cl.
*A47B 88/407* (2017.01)
*A47B 88/427* (2017.01)

(52) U.S. Cl.
CPC ..... *A47B 88/407* (2017.01); *A47B 88/427* (2017.01); *A47B 2088/4278* (2017.01); *A47B 2210/0054* (2013.01); *A47B 2210/0056* (2013.01)

(58) Field of Classification Search
CPC ..... A47B 88/407; A47B 88/427; A47B 2088/4278; A47B 2210/0054; A47B 2210/0056
USPC ..... 312/334.4, 334.5, 348.4
See application file for complete search history.

(56) References Cited

U.S. PATENT DOCUMENTS 5,131,733 A 7/1992 Lautenschlager et al.
8,424,984 B2 4/2013 Ritter
8,464,408 B2 * 6/2013 Hazzard ..... A47B 88/43 24/706.8
10,085,558 B2 10/2018 Klaus
10,149,539 B2 * 12/2018 McGregor ..... A47B 88/427
(Continued)

FOREIGN PATENT DOCUMENTS

DE 4012650 A1 10/1991
DE 102014104136 A1 10/2015
(Continued)

OTHER PUBLICATIONS

International Search Report for PCT/PCT/EP2018/081047 dated Jan. 22, 2019 (with English translation).
(Continued)

*Primary Examiner* — James O Hansen
(74) *Attorney, Agent, or Firm* — Collard & Roe, P.C.

(57) ABSTRACT

A device for fixing a drawer-type element on a rail of a pullout guide has a clamping mechanism, which has a housing having a receptacle into which an oblong retaining part is insertable to fix it on the housing.

17 Claims, 21 Drawing Sheets

(56) References Cited

U.S. PATENT DOCUMENTS

| | | | | |
|---|---|---|---|---|
| 10,299,587 | B2 | 5/2019 | Stuffel et al. | |
| 10,314,397 | B2 | 6/2019 | Stuffel et al. | |
| 10,791,832 | B2 * | 10/2020 | Chen | A47B 88/407 |
| 2002/0158557 | A1 * | 10/2002 | Weichelt | A47B 88/427 312/334.4 |
| 2004/0239219 | A1 * | 12/2004 | Kim | A47B 88/427 312/334.4 |
| 2008/0303396 | A1 * | 12/2008 | Yoon | A47B 88/467 312/334.44 |
| 2012/0080988 | A1 * | 4/2012 | Greussing | A47B 88/427 312/334.6 |
| 2012/0292465 | A1 * | 11/2012 | Holzer | A47B 88/427 248/201 |
| 2013/0257244 | A1 * | 10/2013 | Salice | A47B 88/423 312/319.1 |
| 2014/0314347 | A1 * | 10/2014 | Huang | A47B 88/407 384/22 |

FOREIGN PATENT DOCUMENTS

| | | | |
|---|---|---|---|
| DE | 102015106873 | A1 | 11/2016 |
| WO | 2009149479 | A1 | 12/2009 |
| WO | 2016/116288 | A1 | 7/2016 |
| WO | 2016116288 | A1 | 7/2016 |
| WO | 2016177731 | A1 | 11/2016 |

OTHER PUBLICATIONS

German Search Report dated Mar. 27, 2019 issued in the corresponding German Application 10 2018 114 712.0 (with English translation of relevant parts).

* cited by examiner

DEVICE FOR FIXING A DRAWER-TYPE ELEMENT AND PIECE OF FURNITURE

CROSS REFERENCE TO RELATED APPLICATIONS

This application is the National Stage of PCT/EP2018/081047 filed on Nov. 13, 2018, which claims priority under 35 U.S.C. § 119 of German Application No. 10 2017 127 749.8 filed on Nov. 23, 2017 and of German Application No. 10 2018 114 712.0 filed on Jun. 19, 2018, the disclosures of which are incorporated by reference. The international application under PCT article 21(2) was not published in English.

BACKGROUND OF THE INVENTION

The present invention relates to a device for fixing a drawer-type element on a rail of a pullout guide, having a clamping mechanism, which comprises a housing having a receptacle into which an oblong retaining part is insertable to fix it on the housing.

WO 2016/177731 A1discloses a device for fixing a drawer-type element, in which a web-shaped retaining part is insertable into a receptacle of a clamping mechanism. To secure the retaining part in a friction-locked manner against withdrawal, a self-inhibiting clamping lever is provided in the receptacle, which prevents the retaining part from being able to be pulled out of the receptacle again. The retaining part may be fixed continuously by the friction-locked connection. The pivotable clamping lever requires a comparatively large amount of installation space to provide high clamping forces and the axis of rotation of the clamping lever is subjected to high loads.

SUMMARY OF THE INVENTION

It is therefore the object of the present invention to provide a device for fixing a drawer-type element which is compactly constructed and provides high retaining forces during a continuous adjustment of the retaining part in relation to the housing.

This object is achieved by a device having the features of claim 1.

In the device according to the invention, at least one movable clamping body is provided in a receptacle of a housing, which presses on one side against an oblong retaining part and on the opposing side against a supporting wall, which is aligned inclined in relation to the insertion direction of the retaining part. The retaining part can thus be moved in the insertion direction in the receptacle, wherein the clamping body permits an insertion movement, but secures the retaining part against withdrawal. The clamping body is self-inhibiting in the traction direction opposite to the insertion direction due to the support wall aligned inclined in relation to the insertion direction and increases the friction forces on the retaining part in the event of traction forces. The retaining part can thus be secured on the housing against withdrawal in a compact construction having one or more clamping bodies.

The retaining part is preferably insertable between at least two rotatable clamping bodies, which are each supported by a support wall on the side facing away from the retaining part. The two support walls can spread open in a wedge shape in the insertion direction in this case, so that clamping bodies are supported on both sides on a support wall extending in an inclined manner. The angle between the insertion direction of the retaining part and the support wall can be between 1° and 20°, in particular 2° to 8°. The retaining part can thus be fixed continuously in any position on the housing.

In one design, a disengagement element is provided, by means of which the clamping of the retaining part on the at least one clamping body can be disengaged. For this purpose, the at least one clamping body can be moved in the insertion direction via the disengagement element, for example, by sliding or pivoting the disengagement element. As soon as the clamping body has been moved slightly in the insertion direction, the retaining part may be smoothly withdrawn from the housing.

In a further design, the clamping of the retaining part on the at least one clamping body can be disengaged by the clamping body being moved at an angle of approximately 90° in relation to the insertion direction of the retaining part. This movement direction can be provided in addition to the disengagement element in order to provide a second removal direction of the drawer-type element.

For a simple construction, the support walls are preferably formed integrally with the housing. The clamping mechanism can thus be provided using only a few components. The clamping bodies can be formed as balls, barrels, or cylinders, which are inserted into the receptacle of the housing. The retaining part can be formed as a web or rod, preferably made of metal, to be able to transmit high retaining forces. For a simple installation, a slotted opening can be formed on the housing for the insertion of the retaining part, wherein the slotted opening can be provided both horizontally, vertically, or also in another alignment in the installed position in order to avoid incorrect installation. The opening can also be provided as a polygonal or round opening.

To secure the clamping position, the disengagement element can be pre-tensioned via a spring in the clamping position. Alternatively or additionally, the clamping bodies can also be pre-tensioned via a spring in the clamping position.

The housing is preferably fixed on a drawer, in particular on a bottom of the drawer, and the retaining part is fixed on the pullout guide or formed integrally therewith. The housing can also be fixed on the frame or formed integrally therewith. Of course, the housing of the clamping mechanism can also be fixed on the pullout guide, and the retaining part on the drawer, to fix a drawer in the pullout direction on the pullout guide.

In a further design, the housing or the retaining part is held on an adjustment unit to fix the drawer-type element adjustably in relation to the rail in at least one direction. The adjustment unit can comprise, for example, means for vertical adjustment and/or means for lateral adjustment. For a lateral adjustment, the housing can be displaceably mounted on an installation part and can be positionable on the installation part via an adjustment element, such as a knurled nut, a threaded bolt, or other adjustment means. For a vertical adjustment, for example, a wedge-shaped adjustment element can be provided, which is displaceably mounted to vary a distance between the drawer-type element and the housing. The adjustment element can be locked or fastened in another manner in the desired position.

Furthermore, the clamping mechanism according to the invention can be unlockable via an unlocking element. Such an unlocking element can be designed as a slide, for example, which moves the retaining part in a direction perpendicular to the insertion direction into the housing in order to disengage the retaining part from the clamping bodies. For this purpose, the unlocking element can be formed as a wedge-shaped slide or pivotable lever.

BRIEF DESCRIPTION OF THE DRAWING FIGURES

DETAILED DESCRIPTION OF THE INVENTION

Figure 1:
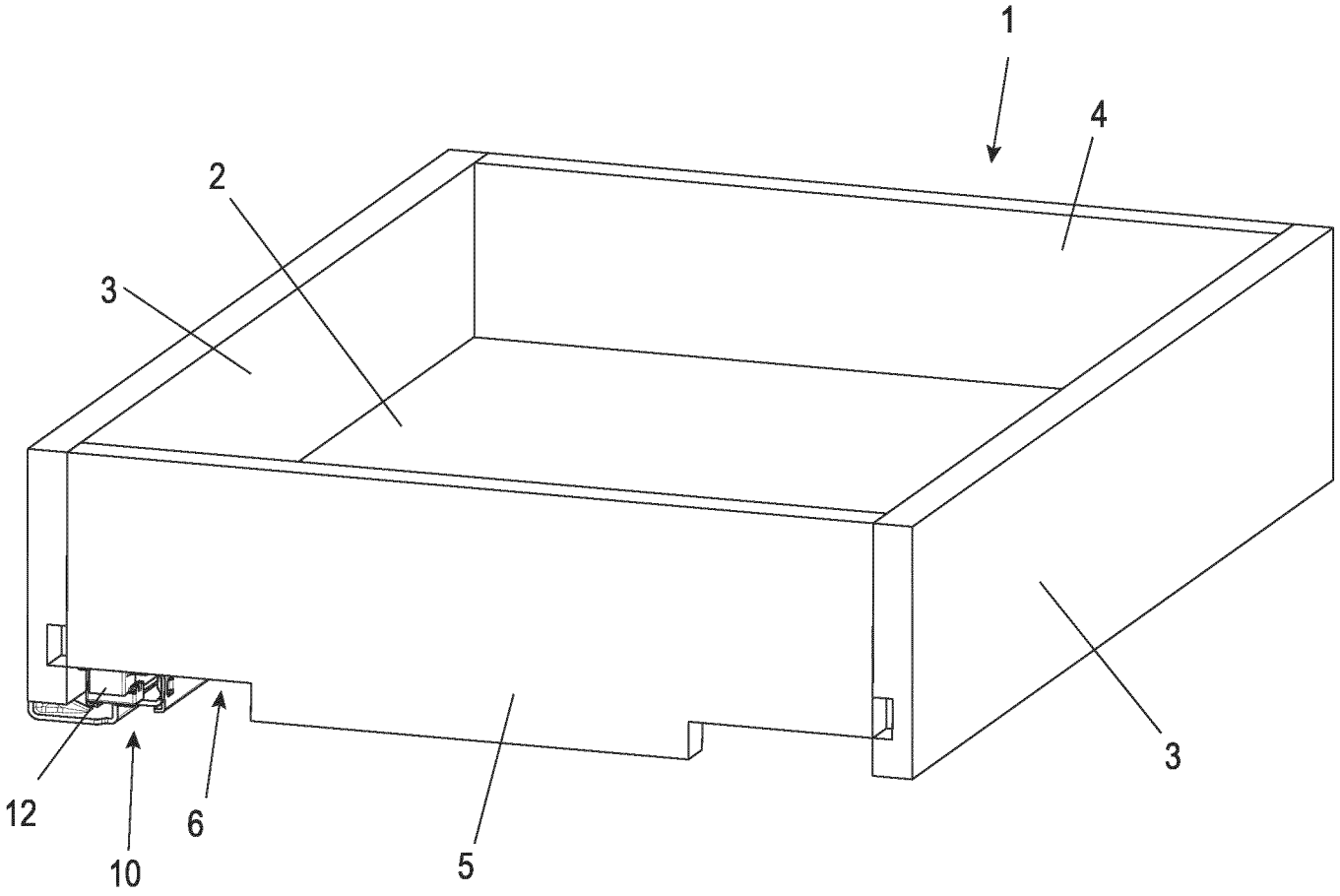
FIG. 1 shows a perspective view of a drawer which is fixed via a device according to the invention on a pullout guide.

A drawer-type element 1 is designed as a drawer and comprises a bottom 2 and two side walls 3, which connect a front wall 5, in front of which a decorative front panel can be placed if needed, to a rear wall 4. The drawer-type element 1 can be used in a piece of furniture or domestic appliance and is held movably via pullout guides 6, wherein only one of two pullout guides 6 is shown in the drawings.

To fix the drawer-type element 1 on a pullout guide 6, a clamping mechanism 10 is provided, which comprises a housing 12 fixed on the bottom 2 of the drawer-type element 1. The clamping mechanism 10 furthermore comprises a web-shaped retaining part 11, which is fixed on a movable slide rail 8 of the pullout guide 6 or is formed integrally therewith. The slide rail 8 is mounted via roller bodies on a guide rail 7, which is fixable on a body of a piece of furniture or a domestic appliance. Optionally, a pullout-extending middle rail can be provided between the slide rail 8 and the guide rail.

Figure 2:
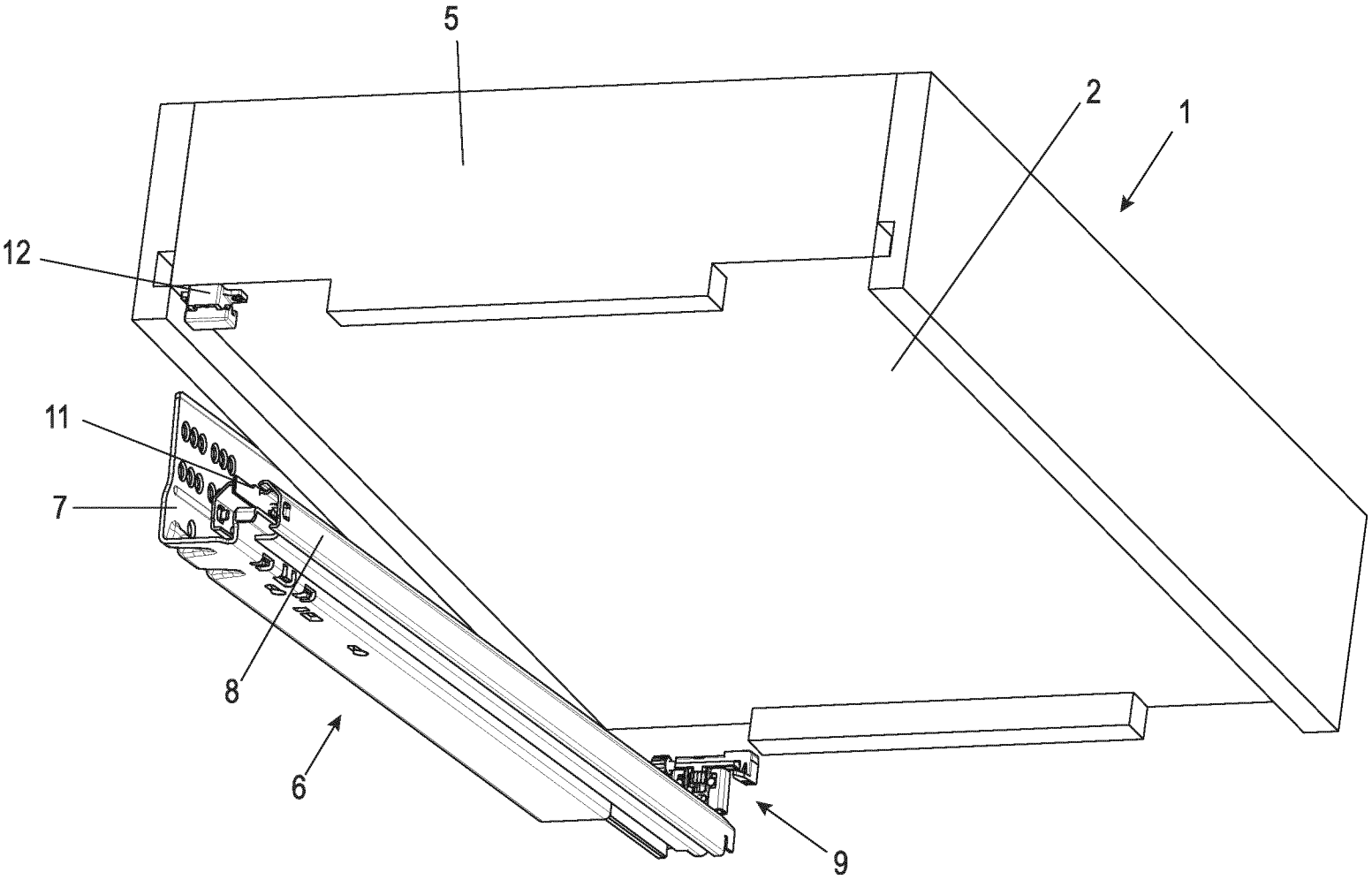
FIG. 2 shows a view of the drawer of FIG. 1 during the installation.
Figure 3:
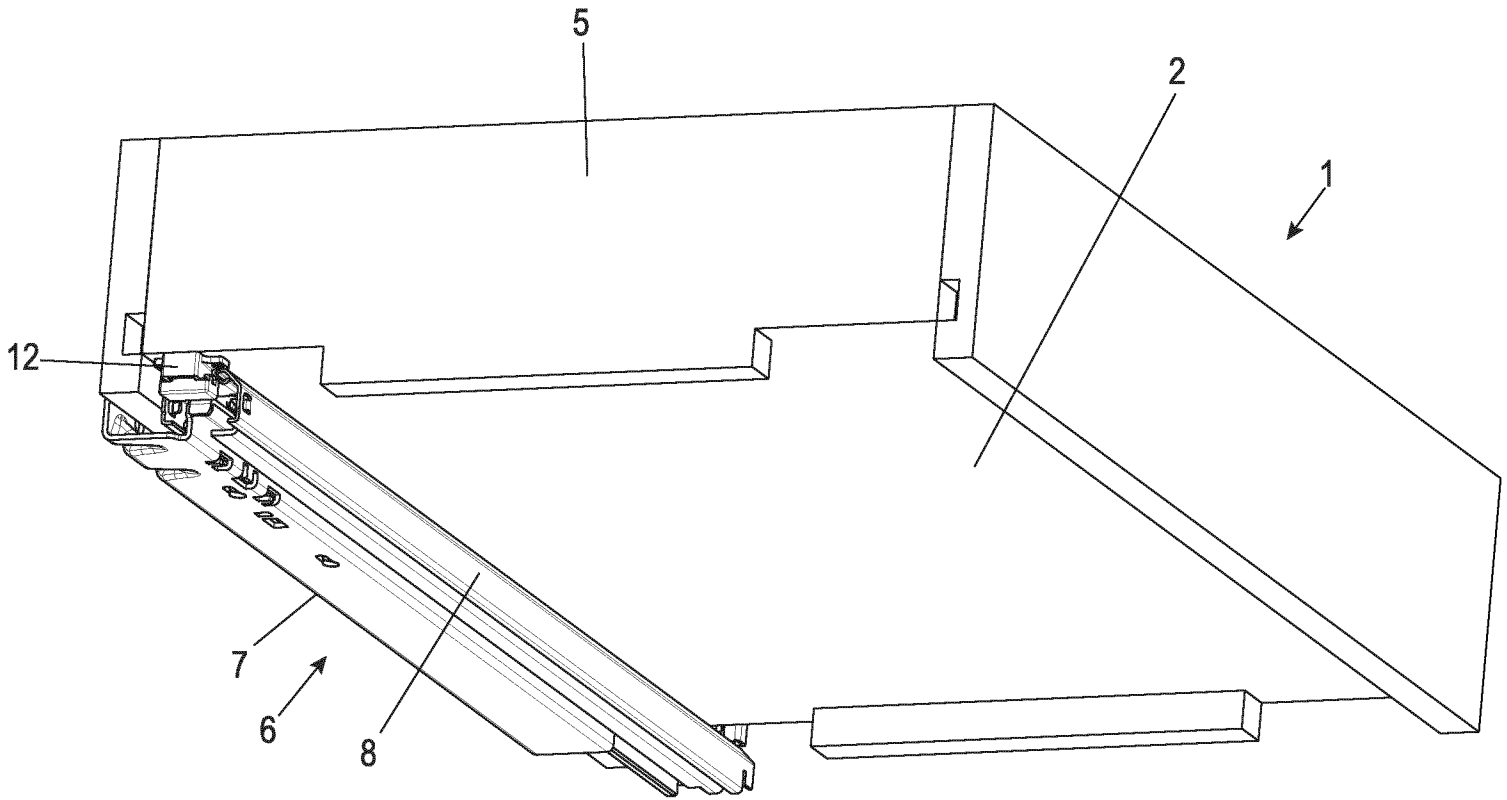
FIG. 3 shows a view of the drawer of FIG. 1 in the installed position.

As shown in FIG. 2, the housing 12 is located in the region of a front wall 5 of the drawer-type element 1 on which a front panel can be attached, and the oblong retaining part 11 is aligned in parallel to the movement direction of the slide rail 8. An adjustable retaining unit 9 is provided in the rear region of the slide rail 8, and the clamping mechanism 10 of the device according to the invention is thus located in the front region of the drawer-type element 1, wherein the position before the installation is shown in FIG. 2 and the position after the installation is shown in FIG. 3.

Figure 4:
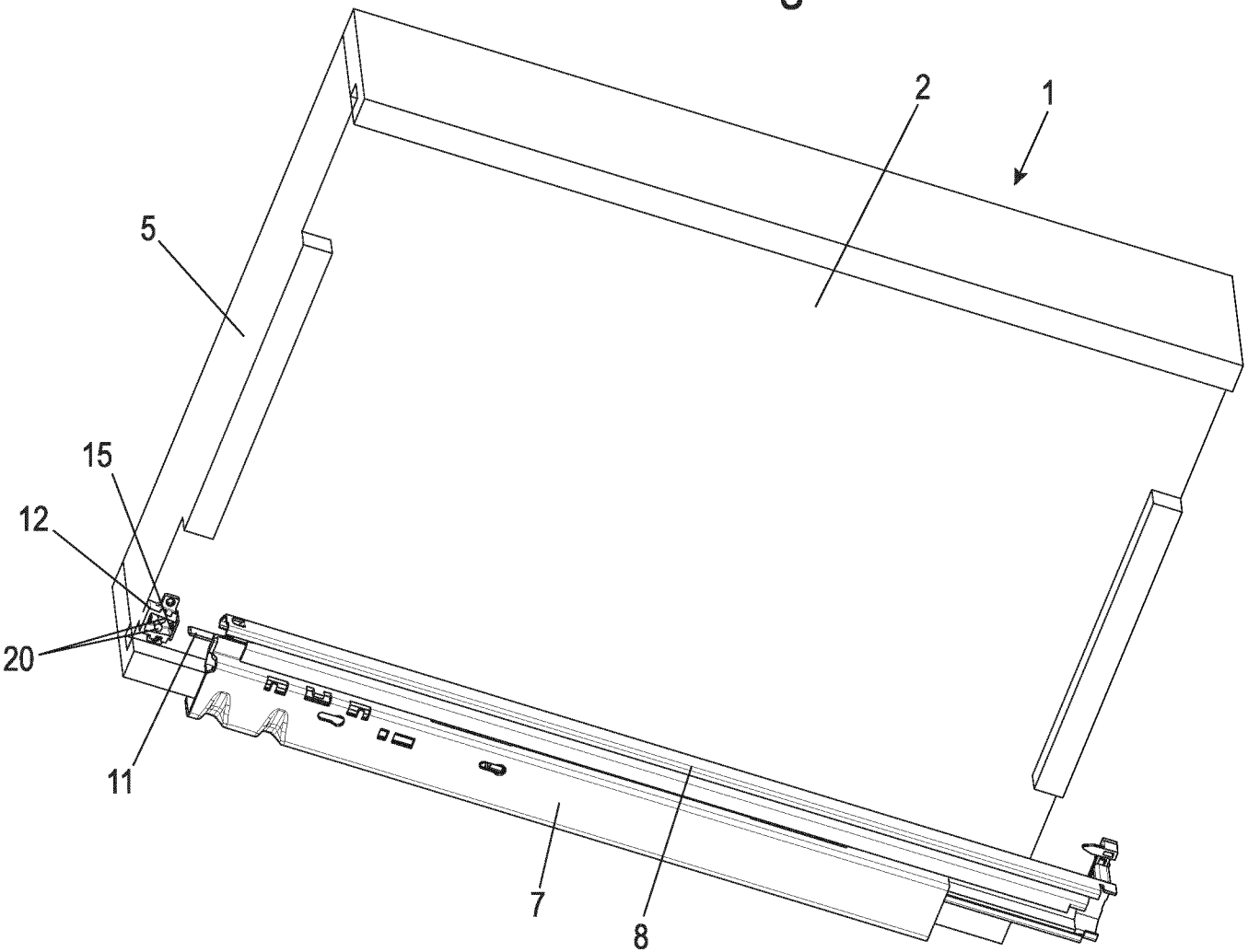
FIG. 4 shows a view of the drawer of FIG. 1 during the installation with a view into the housing.
Figure 5:
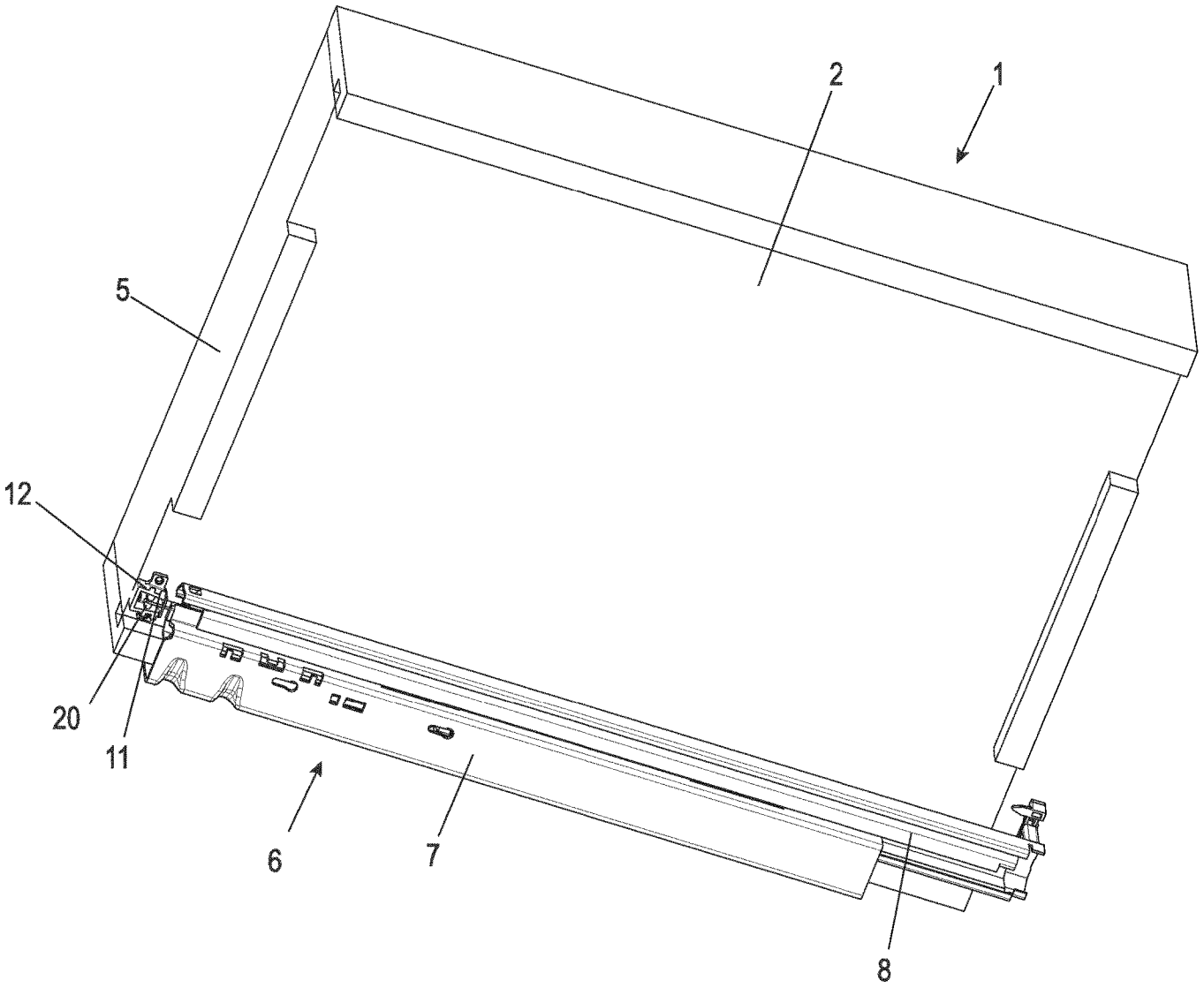
FIG. 5 shows a view of the drawer of FIG. 4 in the installed position with a view into the housing.

The installation of the retaining part 11 on the housing 12 with open housing is shown in FIGS. 4 and 5. The housing 12 comprises a receptacle 15, in which clamping bodies 20 are provided, which are formed in the illustrated exemplary embodiment as balls, in particular as steel balls. In this example, four clamping bodies 20 are provided, two of which are each arranged one over the other. Another number of clamping bodies 20 can also be provided. However, the clamping bodies 20 can also be formed as barrels, cylinders, or other rotational bodies. The retaining part 11 is installed simply by insertion into the housing 12 between two clamping bodies 20, which prevent withdrawal of the retaining part 11 after the installation in a self-inhibiting manner. The clamping bodies 20 can also be provided only on one side of the retaining part 11 in the housing 12. In this case, the clamping bodies 20 act from one side on the retaining part 11 and a wall is provided on the opposite side, against which the retaining part 11 presses.

Figure 6A:
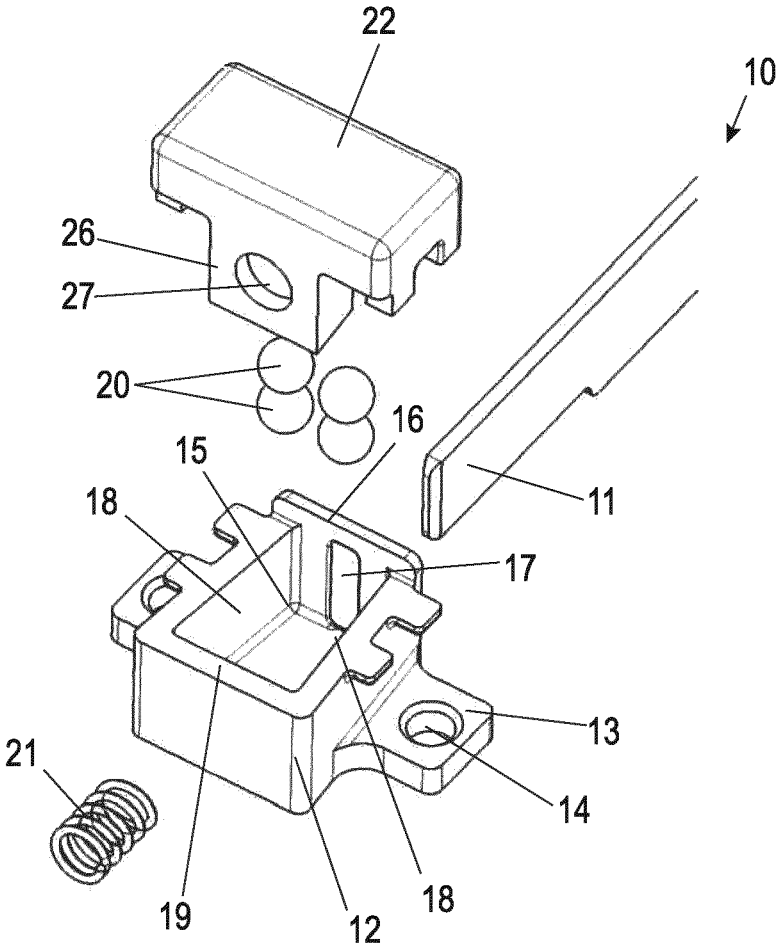
FIGS. 6A and 6B show two perspective exploded illustrations of the clamping mechanism of the device according to the invention.
Figure 6B:
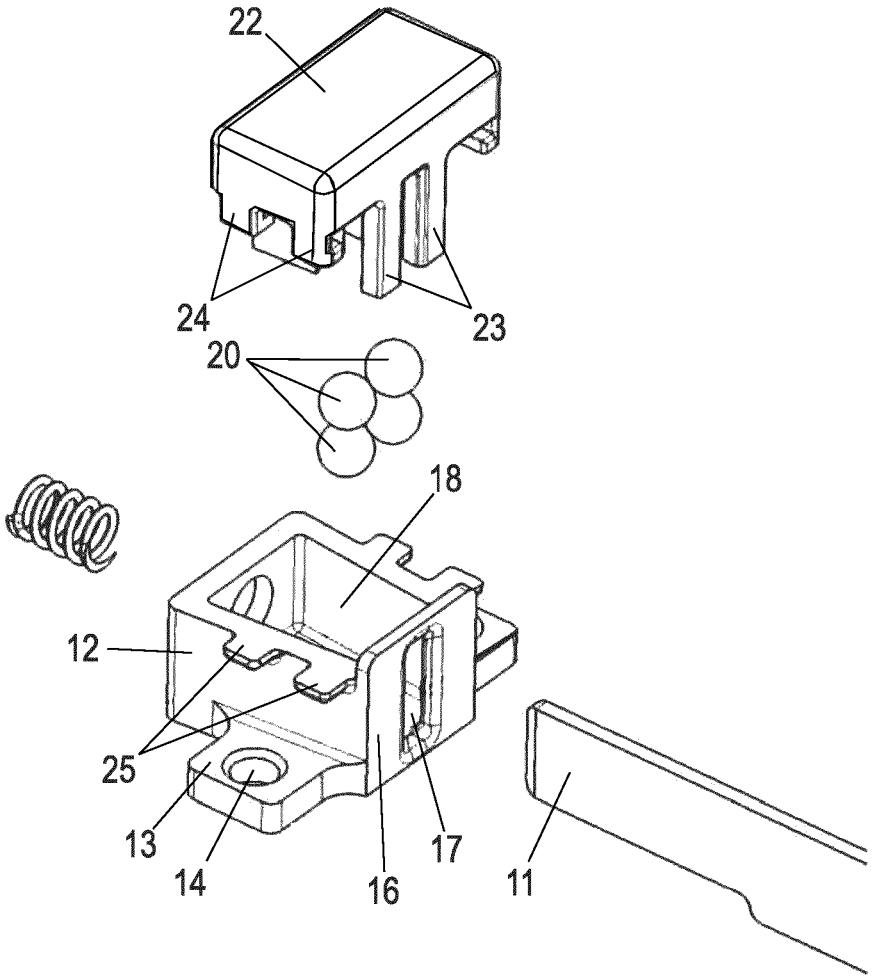

The clamping mechanism 10 is shown having all individual parts in FIGS. 6A and 6B. The housing 12 comprises a chamber-shaped receptacle 15, which comprises a front wall 16 having a slotted opening 17, through which the web-shaped retaining part 11 is insertable. Furthermore, a rear wall 19 is provided and the support walls 18 connecting the front wall 16 and the rear wall 19, which spread out in a wedge shape from the front wall 16 toward the rear wall 19. The angle of the support walls 18 in relation to the insertion direction of the retaining part 11 is preferably in a range between 1° to 20°, in particular 2° to 8°.

The housing 12 comprises outwardly protruding cantilevers 13, in which installation openings 14 are left out to be able to fix the housing 12 on a further component, such as a bottom 2 or a side wall 3 of a drawer.

Multiple clamping bodies 20 are located in the receptacle 15, which are formed in the illustrated exemplary embodiment as balls, wherein the retaining part 11 is insertable between each two clamping bodies 20.

To be able to disengage the clamping mechanism 10 from a clamped position, a disengagement element 22 is provided, which is pre-tensioned by a spring 21 in a clamping position. For this purpose, the spring 21 is supported on one side on the rear wall 19 and on the opposing side on a wall 26 of the disengagement element 22, wherein a receptacle opening 27 for fixing one end of the spring 21 is formed in the wall 26. The disengagement element 22 is thus pre-tensioned by the spring 21 toward the front wall 16. The clamping bodies 20 can be held and guided simultaneously in the disengagement element 22, whereby it would be ensured that the clamping position is not disengaged inadvertently. The disengagement element 22 comprises two webs 23 protruding into the receptacle 15, which press against the clamping bodies 20. The disengagement element 22 can be moved in the insertion direction against the force of the spring 21, whereby the clamping bodies 20 are also moved slightly in the insertion direction of the retaining part 11 via the webs 23 in order to disengage the clamping of the retaining part 11 between the clamping bodies 20. The clamping is disengaged by the wedge-shaped spreading support walls 18 during a movement of the clamping bodies 20 in the insertion direction. The gap which is formed by the webs 23 can extend up to the upper side of the disengagement element 22. The opening 17 can also be embodied as open in the direction of the disengagement element 22. In this case, the clamping of the clamping bodies can be produced by movement in the direction of the open regions. The disengagement movement of the retaining part 11 is thus transverse to the joining direction of the retaining part 11.

The disengagement element 22 overlaps the housing 12 and comprises two guide elements 24, which overlap two lateral cantilevers 25 on the housing 12. The disengagement element 22 can be displaced slightly in relation to the housing 12 via the guide. The guide elements 24 can be formed hooked and engage below the cantilevers 25 on the housing 12, so that the disengagement element 22 is secured against raising.

Figure 7A:
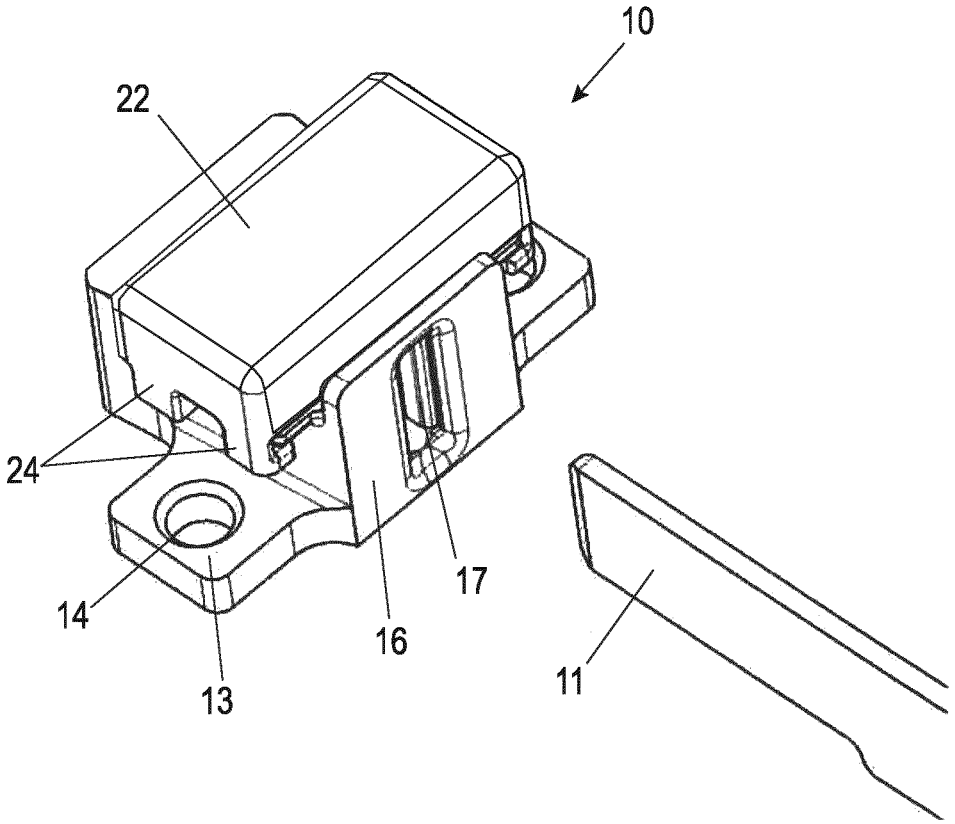
FIGS. 7A and 7B show two views of the clamping mechanism during the installation of the retaining part.
Figure 7B:
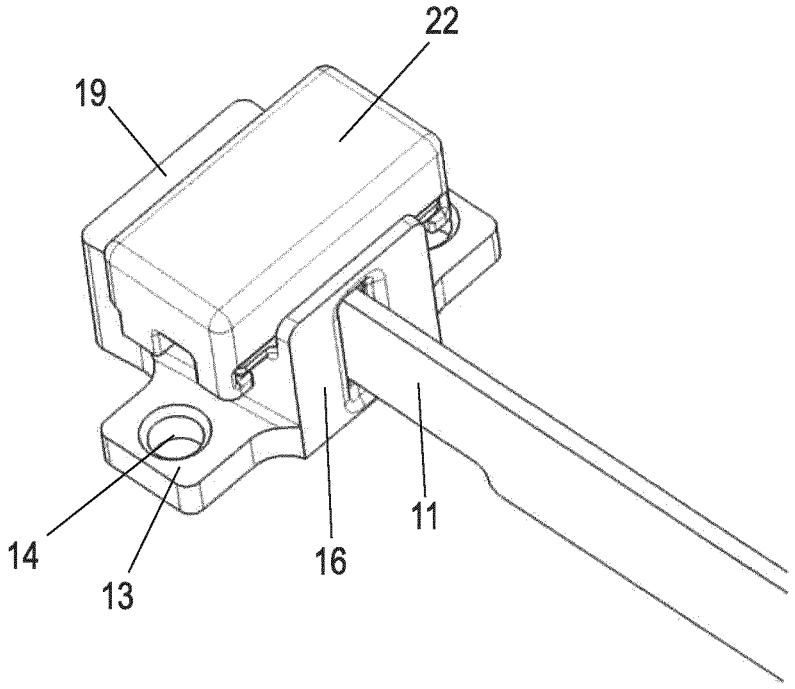

The clamping mechanism 10 is shown before the installation of the retaining part 11 in FIG. 7A. The retaining part 11 is inserted through the slotted opening 17 in the front wall 16 and presses the clamping bodies 20 apart and in the insertion direction toward the rear wall 19. The retaining part 11 can be inserted into the housing 12 until the desired position is reached. The retaining part 11 is subsequently secured against withdrawal and fixed in a friction-locked manner. This position is shown in FIG. 7B.

Figure 8:
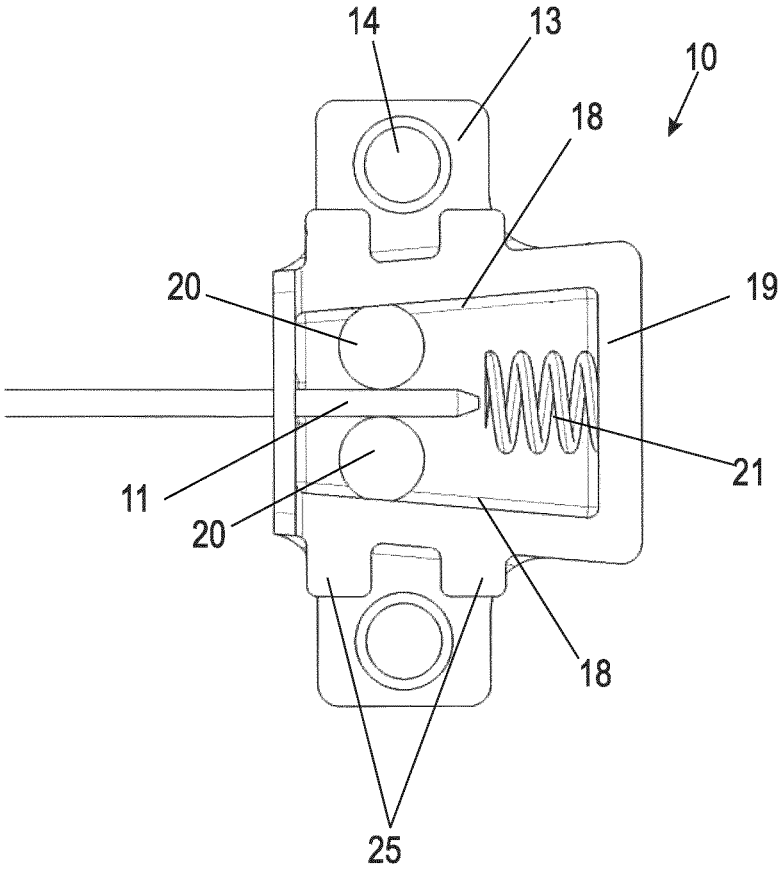
FIG. 8 shows a top view of the clamping mechanism having installed retaining part.

The installed position without the disengagement element 22 is shown in FIG. 8. Clamping bodies 20, which are supported on the side facing away from the retaining part 11 on an support wall 18 extending in an inclined manner, press against the retaining part 11 on opposing sides. If traction forces are applied to the retaining part 11, the clamping forces are increased via the clamping bodies 20 and the support walls 18 and thus prevent withdrawal. To disengage the clamping mechanism 10, the disengagement element 22 can move the clamping bodies 20 in the insertion direction in the direction of the rear wall 19, so that the clamping forces are then disengaged and the retaining part 11 can be withdrawn.

In the illustrated exemplary embodiment, four clamping bodies 20 are used to secure the web-shaped retaining part 11 on the housing 12. It is also possible to provide only two clamping bodies 20 or even one clamping body 20 if the retaining part 11 is supported on a wall of the housing 12. Moreover, the geometry of the cramping bodies 20 can be varied, which can also be aligned in a wedge shape, for example. The retaining part 11 can also be formed rod-shaped, tubular, or having a different geometry instead of web-shaped.

Figure 9:
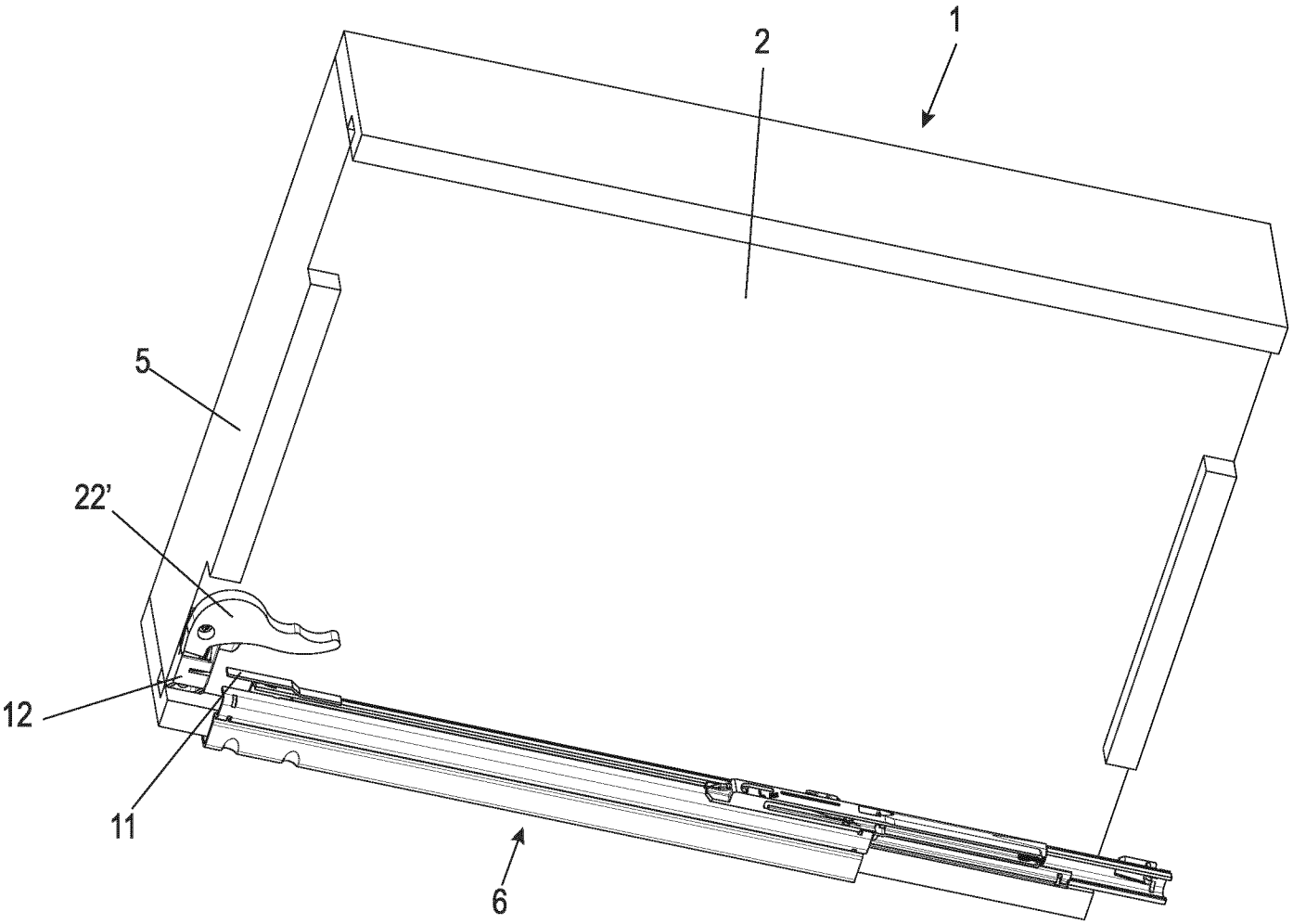
FIG. 9 shows a perspective view of a further exemplary embodiment of a device for fixing a drawer-type element.

A further exemplary embodiment of a device is shown in FIG. 9, in which a displaceable disengagement element 22 is not used for the disengagement of the clamping mechanism 10 on the housing 12, but rather a disengagement element in the form of a pivotable lever 22'. The lever 22' is rotatably mounted on the housing 12 or the bottom 2 of the drawer-type element 1 and can move the clamping bodies 20 slightly in the insertion direction to disengage the clamping of the retaining part 11. The slot 28 is also visible on the housing 12, through which the retaining part can be moved out of the housing transversely to the insertion direction, without actuating the disengagement lever.

Figure 10:
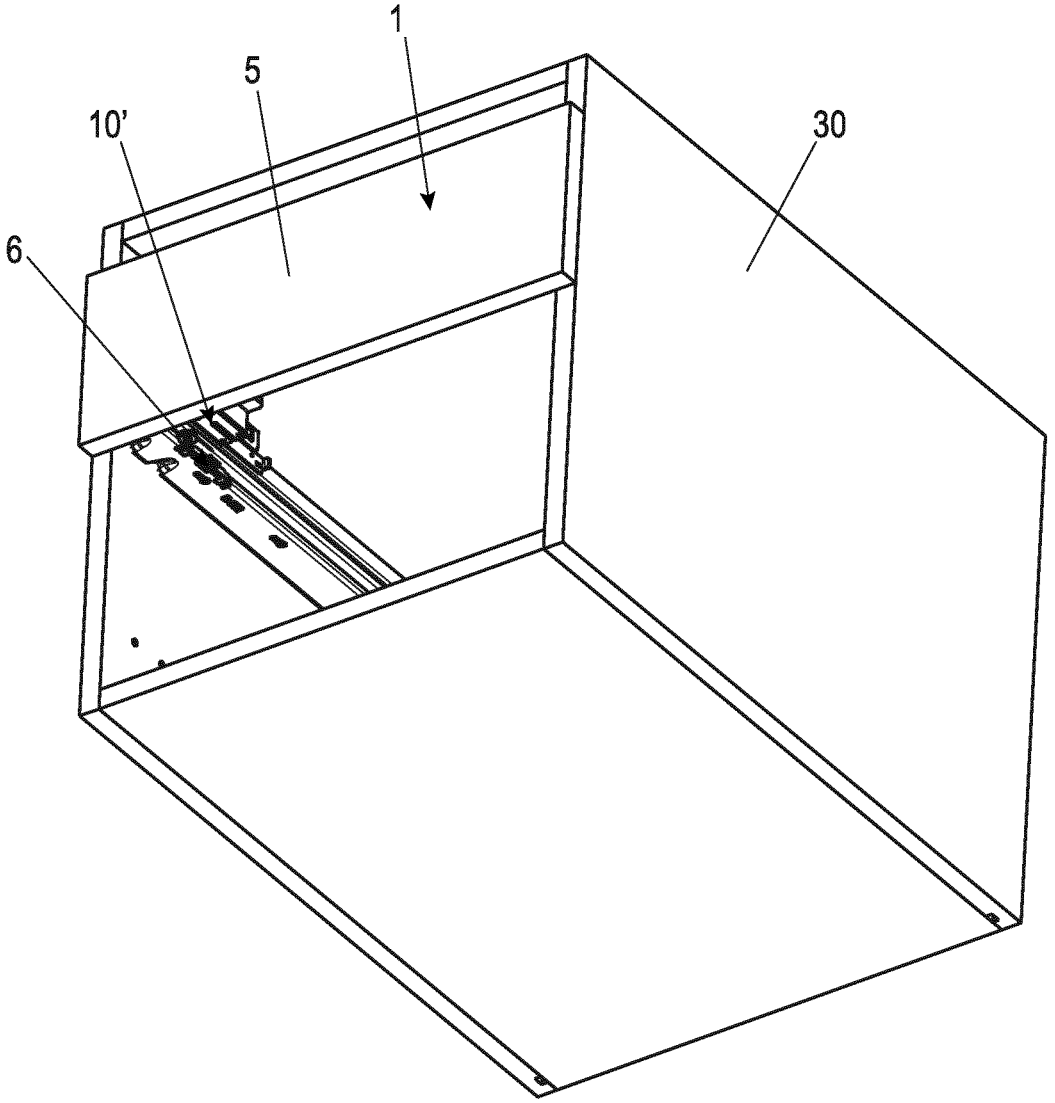
FIG. 10 shows a perspective view of a piece of furniture having a drawer-type element which is fixed via a device according to the invention on a pullout guide.
Figure 11:
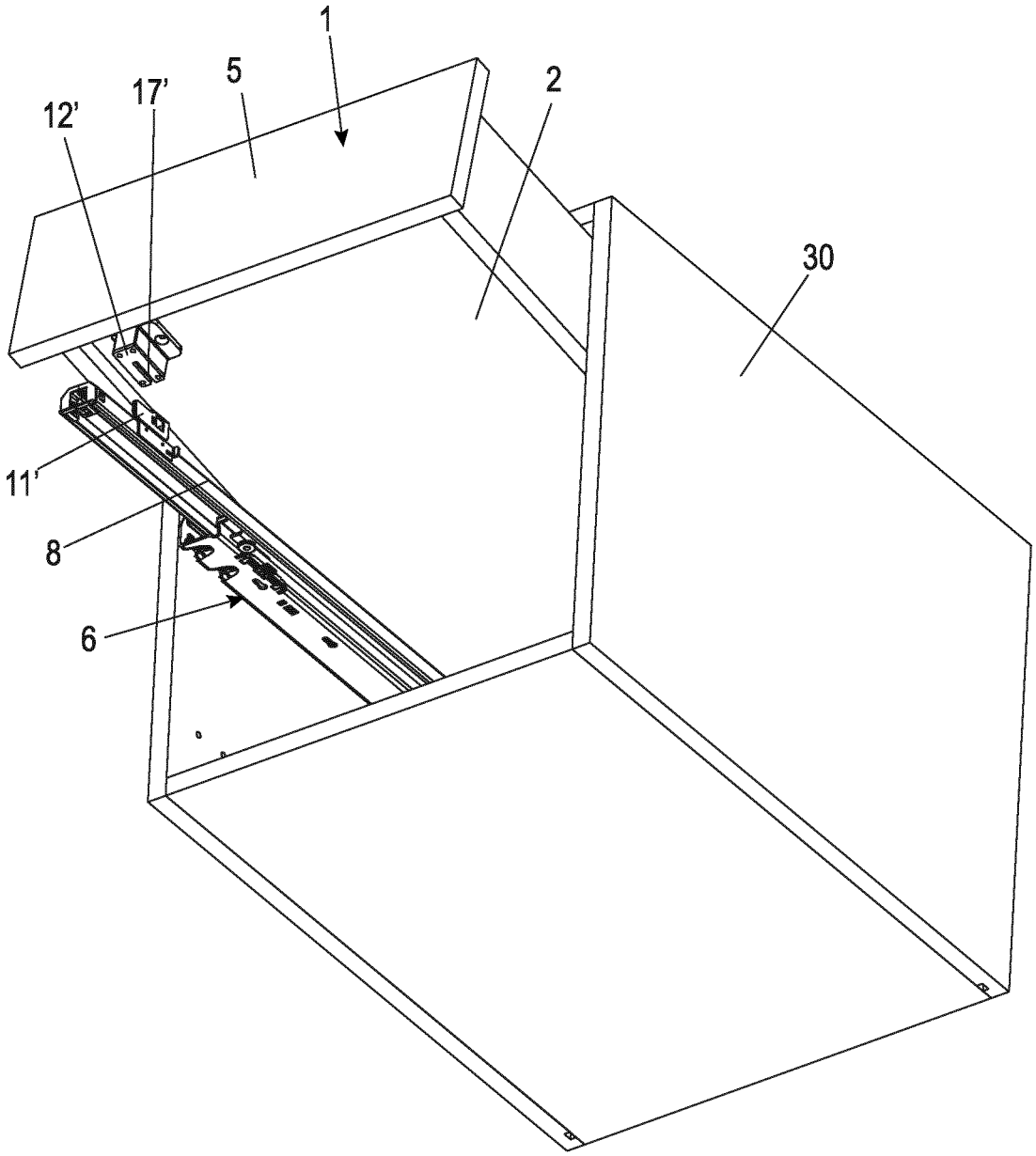
FIG. 11 shows a view of the piece of furniture of FIG. 10 during the installation.

A perspective view of a piece of furniture having a furniture body 30, on which a drawer-type element 1 is fixed on a pullout guide 6, is shown in FIG. 10. A clamping mechanism 10' for fixing the drawer-type element 1 is provided adjacent to a front wall 5 formed as a front panel. For this purpose, a housing 12' is fixed on a bottom 2' of the drawer-type element 1 (FIG. 11). The housing comprises a slotted opening 17', in which a web-shaped retaining part 11' is insertable. The installation direction is in the longitudinal direction of the pullout guide 6 in this case. The retaining part 11' is formed as an angled metal plate, which is fixed, in particular welded, on the slide rail 8 of the pullout guide 6.

Figure 12:
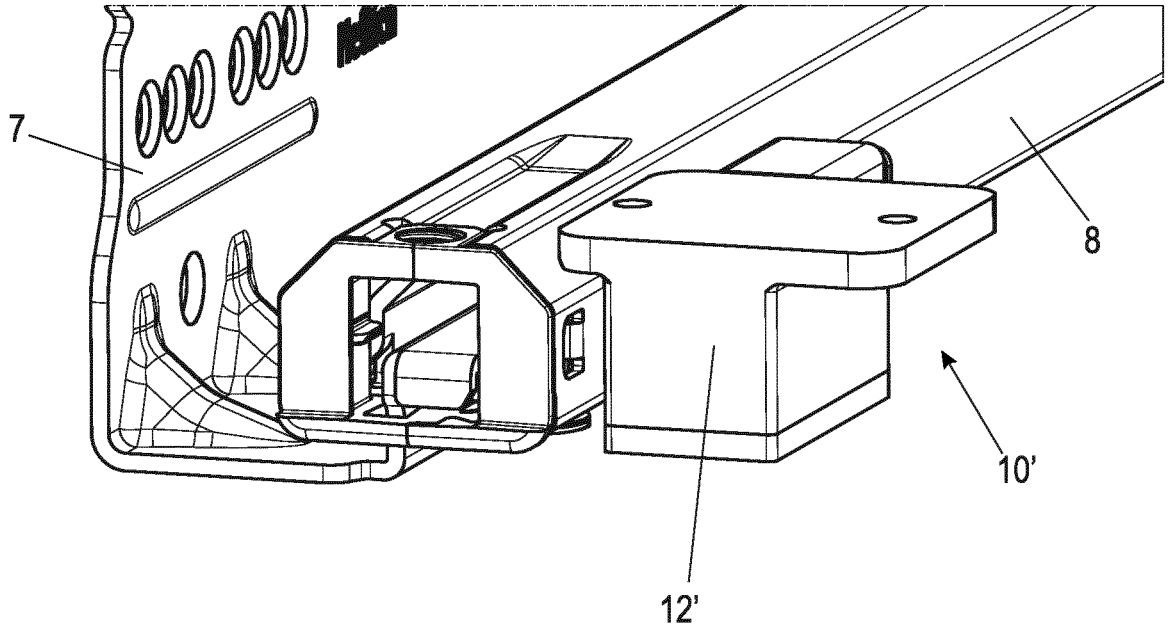
FIG. 12 shows a perspective view of a device for fixing the drawer-type element of FIG. 10.
Figure 13:
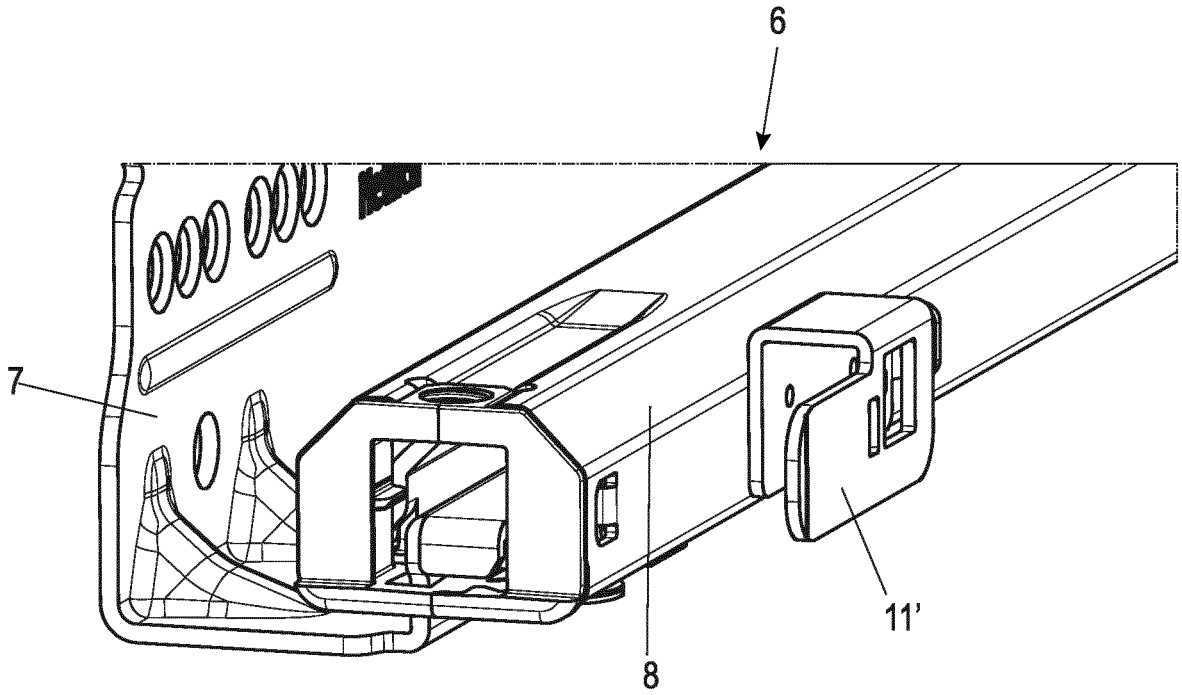
FIG. 13 shows a view of the pullout guide having a retaining part for installing the drawer-type element of FIG. 10.

The clamping mechanism 10' is shown in detail in FIGS. 12 and 13. The housing 12' is located laterally adjacent to the slide rail 8, on which the web-shaped retaining part 11' is fixed. Clamping bodies are located in the housing 12', as was already explained for the preceding exemplary embodiments. The clamping mechanism 10' can be disengaged in this exemplary embodiment by raising the drawer-type element 1, i.e., moving it essentially perpendicularly to the installation direction. The clamping bodies in the housing 12' effectuate blocking against withdrawal of the retaining part 11' in the longitudinal direction of the pullout guide 6, but only minor clamping or friction forces act perpendicularly to this direction, which can be overcome during the removal. Upon raising of the drawer-type element 1, the web-shaped retaining part 11' can thus be guided through downward through the slotted opening 17'.

Figure 14:
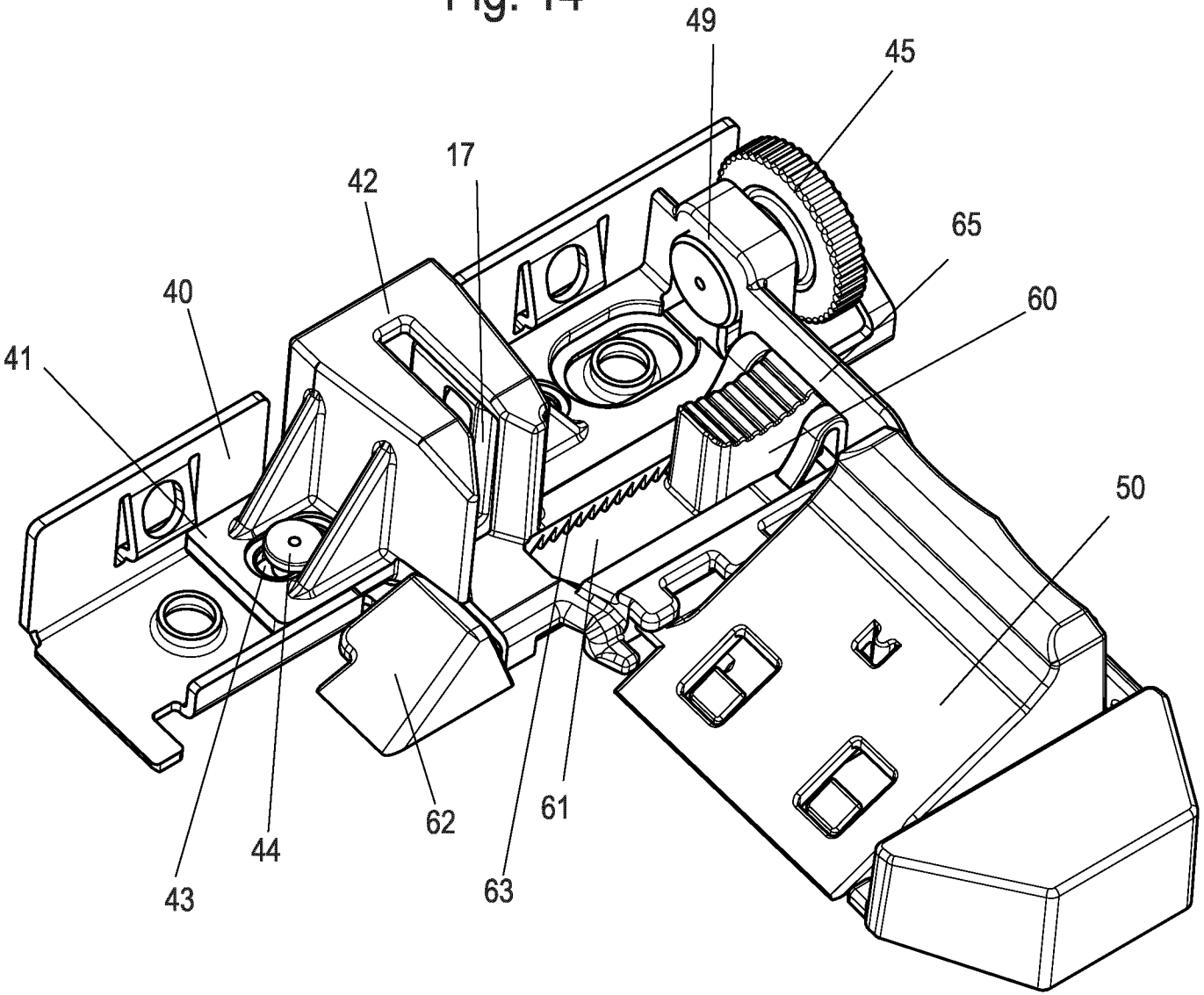
FIG. 14 shows a perspective view of a further exemplary embodiment of a device according to the invention having an adjustment unit.
Figure 15:
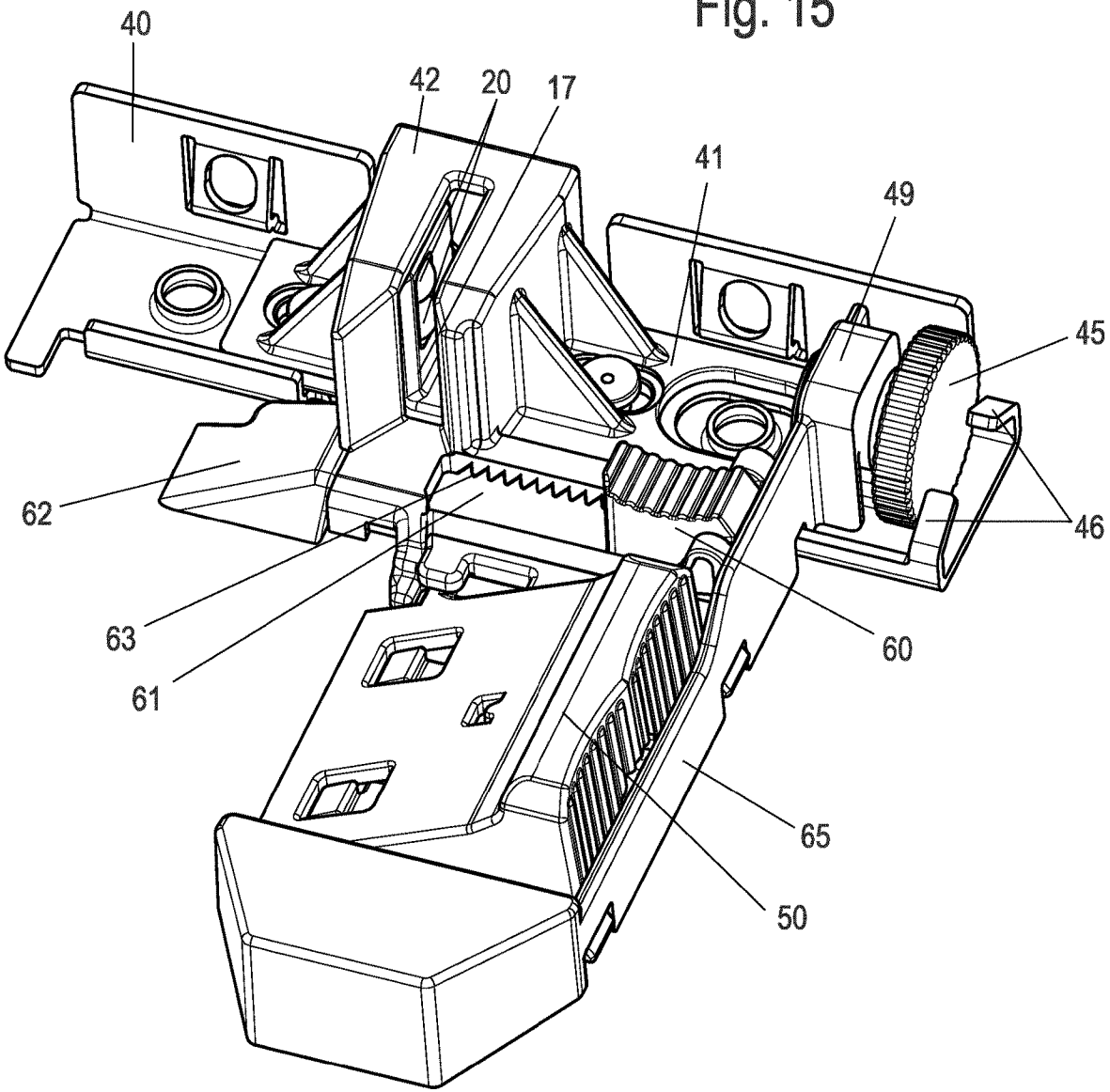
FIG. 15 shows a perspective view of the device of FIG. 14.
Figure 16:
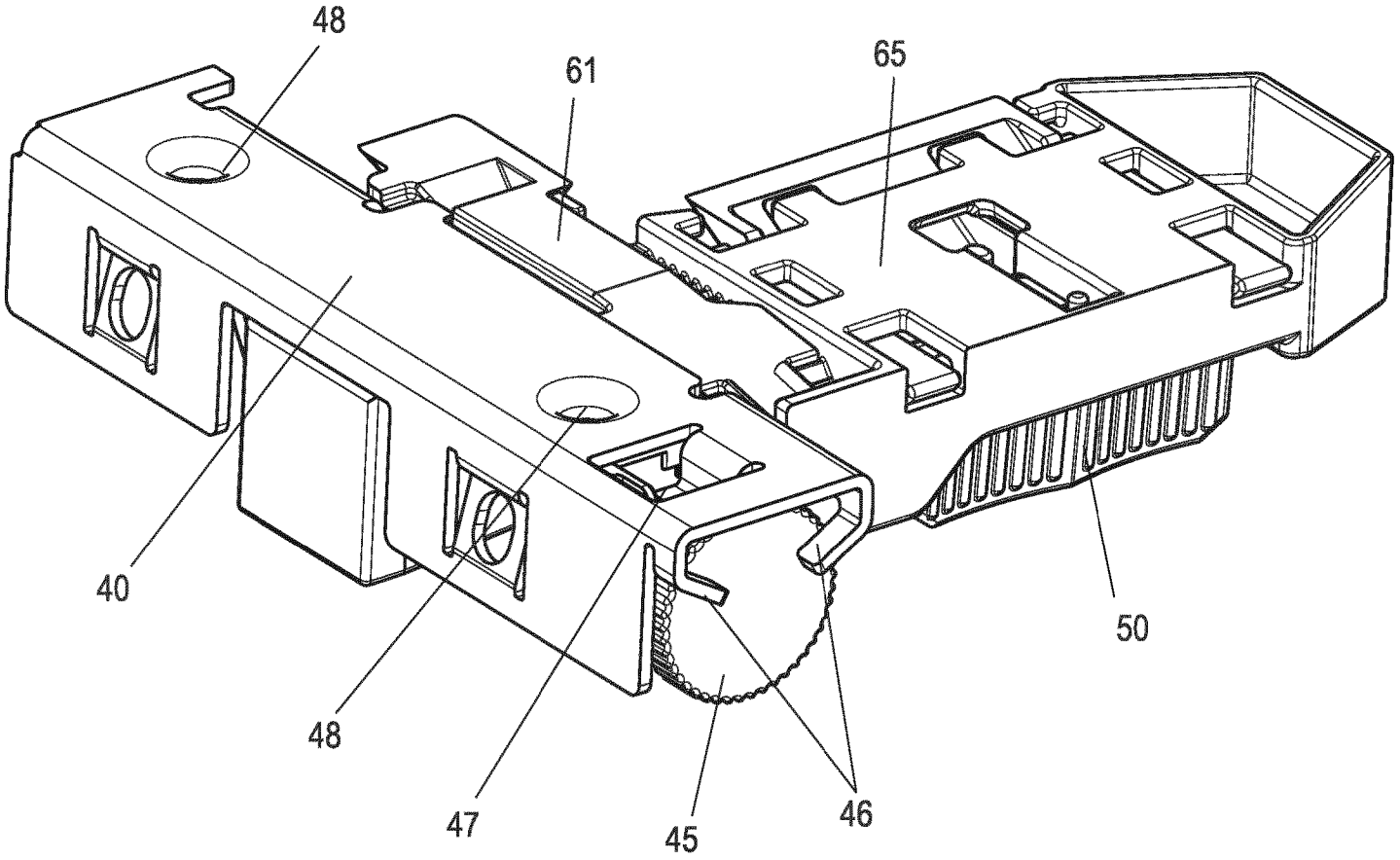
FIG. 16 shows a perspective view of the device of FIG. 14.
Figure 17:
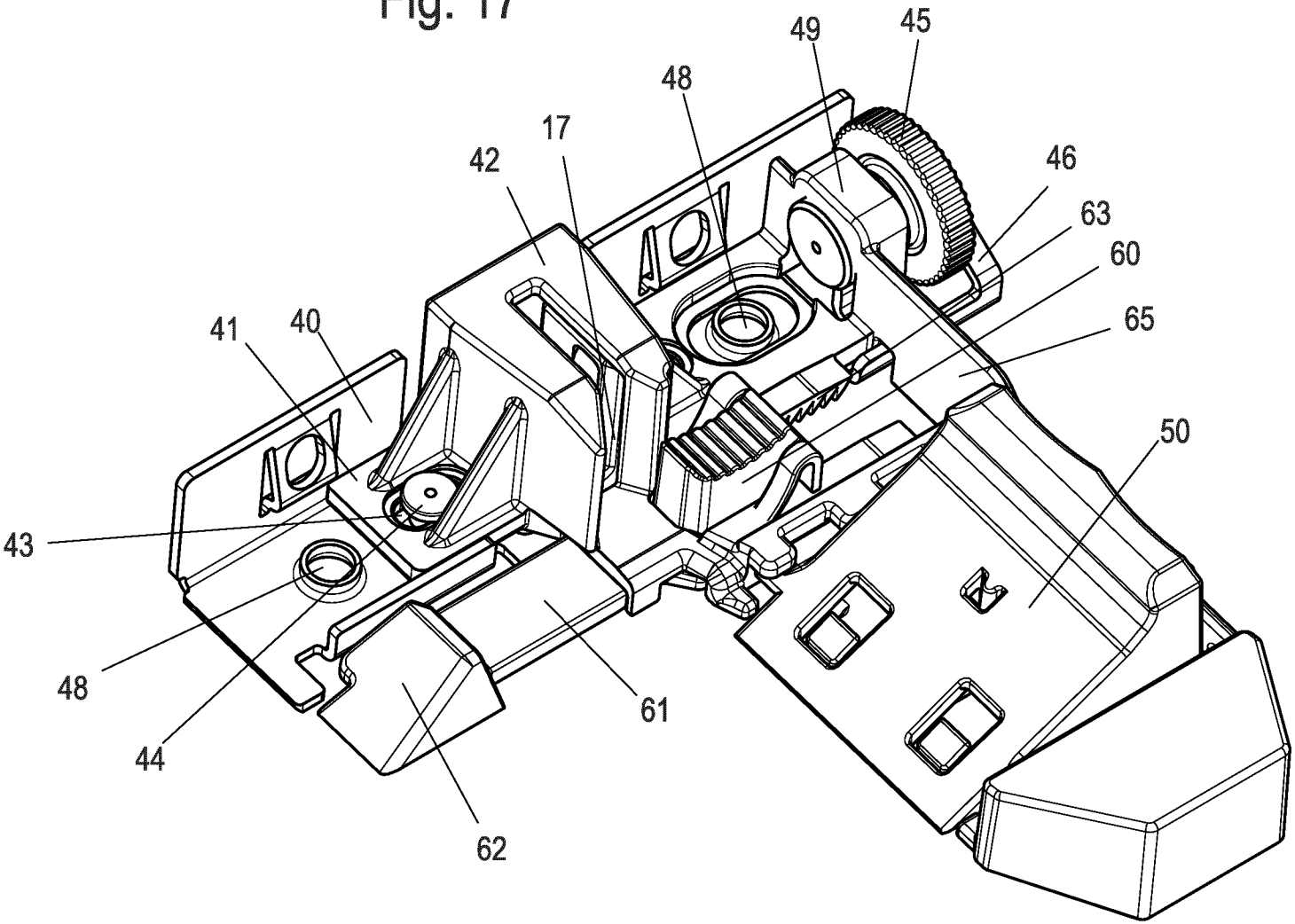
FIG. 17 shows a perspective view of the device of FIG. 14 having a different vertical setting.

A modified device for fixing a drawer-type element is shown in FIGS. 14 to 16, in which a housing 42 is provided, which comprises an opening 17 for inserting a retaining part as in the preceding exemplary embodiments, in order to fix the retaining part in a clamped manner via clamping bodies 20. The housing 42 comprises a slotted opening perpendicularly to the insertion direction, so that the retaining part is removable from the housing 42 perpendicularly to the insertion direction.

The housing 42 is held on an adjustment unit, by means of which a vertical and lateral adjustment can be performed. For this purpose, the housing 42 is provided on a slide 41, which is displaceably mounted on an installation part 40. The installation part 40 comprises guide means for this purpose, for example, bent-over wall sections and/or a guide bolt 44, which extends through an oblong hole 43 on the slide 41. Other guide means can also be provided to mount the slide 41 displaceably on the installation part 40 perpendicularly to the insertion direction of the retaining part. To be able to perform a lateral adjustment, an adjustment element 45 in the form of a knurled nut is provided, which is mounted rotatably but axially non-displaceably on the installation part 40. For this purpose, outer webs 46 and at least one inner web 47, which fix the adjustment element 45 in the axial direction but permit a rotational movement, are provided on the installation part 40. The adjustment element 45 is equipped with a threaded bolt, which engages in a threaded opening on a block 49 of the slide 41, so that by rotating the adjustment element 45, the slide 41 and thus also the housing 42 is linearly adjusted in relation to the installation part 40. This also changes the position of a drawer-type element 1, on which the installation part 40 is fixed, and of a slide rail of a pullout guide, which is fixed indirectly or directly on the housing 42.

Moreover, the adjustment unit also comprises means 60 for vertical adjustment. The means 60 for vertical adjustment are formed as a slide having a wedge-shaped adjustment element 61, which is held displaceably on a cantilever 65 of the adjustment element 61. The wedge-shaped adjustment element 61 comprises a stop 62, which delimits the sliding movement in relation to the slide 41. Gear teeth 63 are provided on the slide 41 in this case, which are engaged with at least one projection or tooth on the means 60 for vertical adjustment, so that the wedge-shaped adjustment element 61 is lockable in different positions on the slide 41.

As the view of FIG. 16 shows, the installation part 40 can be fixed on a lower side of a drawer-type element 1, for example, by screws, which extend through fastening openings 48. The distance between a bottom of the drawer-type element and the housing 42 can be changed by a movement of the wedge-shaped adjustment element 61, which results in a vertical adjustment of the drawer-type element in relation to the pullout guide. The means for vertical adjustment can also be formed by other mechanisms, for example, eccentrics, threaded bolts, or other adjustment means, instead of by a wedge-shaped adjustment element 61.

The device for fixing a drawer-type element furthermore comprises an unlocking element 50, which is held displaceably on the cantilever 65 of the slide 41.

Figure 18:
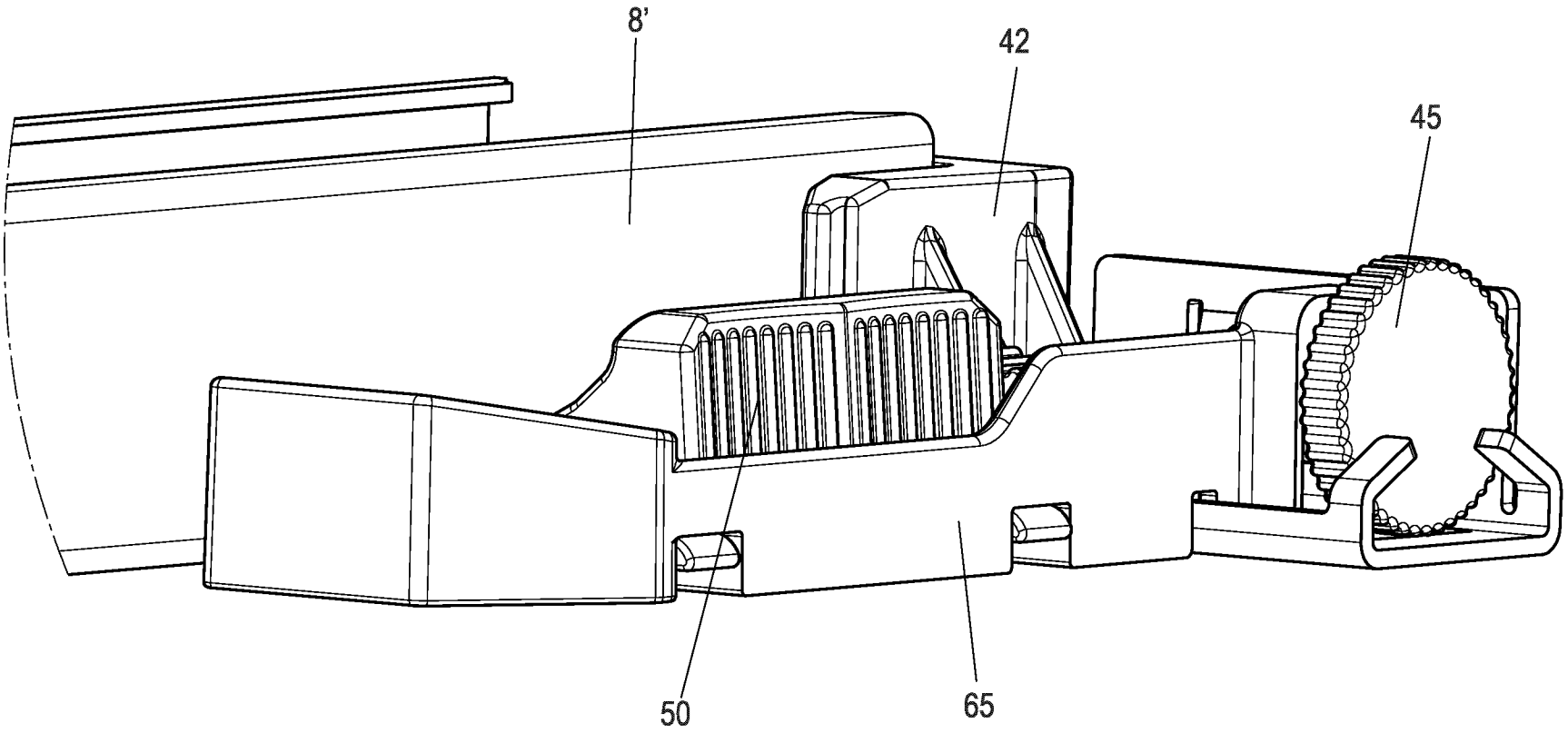
FIG. 18 shows a perspective view of the device of FIG. 14, in which a retaining part is installed on the housing.
Figure 19:
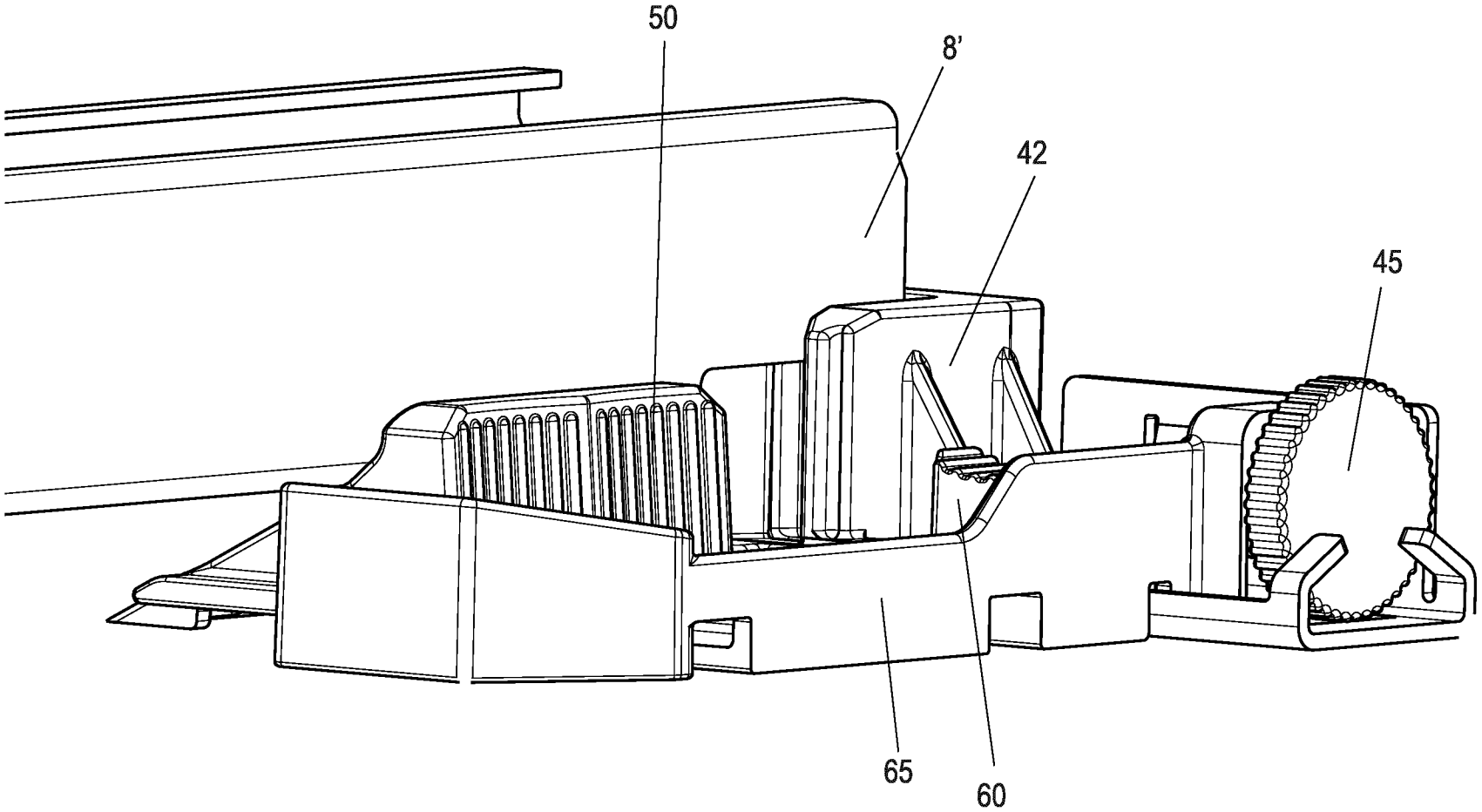
FIG. 19 shows a perspective view of the device of FIG. 18 during the unlocking of the device.

A rail 8' of a pullout guide is fixed on the housing 42 in FIG. 18. Of course, it is also possible to fix a retaining part 11 or 11' on the housing 42, which is permanently connected to a rail of a pullout guide. The rail 8' engages in the opening 17 of the housing 42 and is fixed in a clamped manner via the clamping bodies 20. If the rail 8' is supposed to be unlocked from the clamping position, the unlocking element 50 is displaced on the cantilever 65, as shown in FIG. 19. The wedge-shaped contact surface of the unlocking element 50 presses the rail 8' upward, so that the rail 8' is removed from the housing 42 essentially perpendicularly to the insertion direction. For renewed fastening of the rail 8', the unlocking element 50 can be pushed back again and the rail 8' can be inserted in the longitudinal direction into the housing 42.

LIST OF REFERENCE NUMERALS 1 drawer-type element
2 bottom
3 side wall
4 rear wall
5 front wall
6 pullout guide
7 guide rail
8 slide rail
8' rail
9 retaining unit
10, 10' clamping mechanism
11, 11' retaining part
12, 12' housing
13 cantilever
14 installation opening
15 receptacle
16 front wall
17, 17' opening
18 support wall
19 rear wall
20 clamping body
21 spring
22 disengagement element
22' lever
23 web
24 guide element
25 cantilever
26 wall
27 receptacle opening
28 slot
30 furniture body
40 installation part
41 slide
42 housing
43 oblong hole
44 guide bolt
45 adjustment element
46 web
47 web
48 fastening opening
49 block
50 unlocking element
60 means for vertical adjustment
61 adjustment element
62 stop
63 gear teeth
65 cantilever

What is claimed is:

1. A device for fixing a drawer (1) on a rail (8) of a pullout guide (6), comprising:

a clamping mechanism (10, 10'), which comprises a housing (12, 12', 42) having a support wall facing a receptacle (15), into which an oblong retaining part (11, 11') that is connectable to the rail is insertable to fix the retaining part (11, 11') on the housing (12, 12', 42), at least two movable clamping bodies (20) disposed in the receptacle (15), the at least two clamping bodies (20) pressing on one side on the retaining part (11, 11') and on an opposing side on the support wall (18) to prevent withdrawal of the retaining part (11, 11') after installation of the retaining part in the receptacle, the support wall (18) being aligned inclined in relation to an insertion direction of the retaining part (11, 11') so that the receptacle widens in the insertion direction, wherein the at least two movable clamping bodies (20) are pre-tensioned via a spring (21) in a clamping position, so that the retaining part is movable in the insertion direction in the receptacle, but is prevented from withdrawal from the receptacle by the clamping bodies, and an unlocking element (50) by means of which the retaining part (11, 11') is unlockable from a position locked on the housing (42), the unlocking element being configured to push the retaining part out of the receptacle, perpendicular to the insertion direction.

2. The device according to claim 1, wherein an angle between the retaining part (11, 11') and the support wall (18) is less than a permissible friction angle in dependence on utilized materials of the retaining part (11, 11'), the at least two movable clamping bodies (20), and the support wall (18).

3. The device according to claim 1, wherein the at least two movable clamping bodies (20) comprise at least two rotatable clamping bodies (20), and wherein the retaining part (11, 11') is insertable between the at least two rotatable clamping bodies (20), which are each supported by the support wall (18) on a side facing away from the retaining part (11, 11').

4. The device according to claim 3, wherein two support walls (18) are provided, which spread out in a wedge shape in the insertion direction.

5. The device according to claim 4, wherein the support walls (18) are integrally formed with the housing (12).

6. The device according to claim 3, wherein the clamping bodies (20) are formed as balls, barrels, or cylinders.

7. The device according to claim 3, wherein a clamped connection can be canceled out by a relative movement between the clamping bodies (20) and retaining body (11) transversely to the insertion direction of the retaining part (11).

8. The device according to claim 7, wherein the housing comprises an opening (17') for the retaining part (11'), into which the retaining part (11') is insertable in the insertion direction and is extendable transversely to the insertion direction.

9. The device according to claim 1, wherein an angle between the insertion direction of the retaining part (11) and the support wall (18) is between 1° and 20°.

10. The device according to claim 1, wherein the retaining part (11, 11') is formed as a web.

11. The device according to claim 1, wherein a slotted opening (17, 17') for inserting the retaining part (11, 11') is formed on the housing (12).

12. The device according to claim 1, wherein the housing (12, 12', 42) is arranged on the drawer (1) or integrally formed on the drawer or on a pullout guide (6) or integrally formed on a pullout guide (6) and the retaining part (11) is arranged on a pullout guide (6) or integrally formed on a pullout guide (6) or on a drawer (1) or integrally formed on the drawer.

13. The device according to claim 1, wherein the housing (42) or the retaining part (8') is held on an adjustment unit to be able to fix the drawer (1) adjustably in relation to the rail (8, 8') in at least one direction.

14. The device according to claim 13, wherein the adjustment unit comprises means (60) for vertical adjustment and means for lateral adjustment.

15. The device according to claim 14, wherein a wedge-shaped adjustment element (61) provided for a vertical adjustment, by means of which a distance between the housing (42) and the drawer (1) is adjustable.

16. The device according to claim 13, wherein the housing (42) is displaceably mounted on an installation part (40) for a lateral adjustment and is positionable via an adjustment element (45) on the installation part (40).

17. A piece of furniture having at least one drawer (1), which is held movably via at least one pullout guide (6), and is fixed in a clamping manner on a rail (8) of the pullout guide (6) via a device according to claim 1.

* * * * *